US009499184B2

(12) United States Patent
Schwellnus et al.

(10) Patent No.: US 9,499,184 B2
(45) Date of Patent: Nov. 22, 2016

(54) METHOD OF DETERMINING A POSITION OF A VEHICLE ON A GUIDEWAY

(71) Applicant: Thales Canada Inc, Toronto, Ontario (CA)

(72) Inventors: Carl Schwellnus, York (CA); Colin Bantin, Oakville (CA)

(73) Assignee: Thales Canada Inc, Toronto, Ontario (CA)

( * ) Notice: Subject to any disclaimer, the term of this patent is extended or adjusted under 35 U.S.C. 154(b) by 0 days.

(21) Appl. No.: 14/984,147

(22) Filed: Dec. 30, 2015

(65) Prior Publication Data

US 2016/0107662 A1 Apr. 21, 2016

Related U.S. Application Data

(62) Division of application No. 13/886,674, filed on May 3, 2013, now Pat. No. 9,227,641.

(51) Int. Cl.

| | |
|---|---|
| ***B61L 25/00*** | (2006.01) |
| ***B61L 25/02*** | (2006.01) |
| ***B61L 3/12*** | (2006.01) |
| ***B61L 25/04*** | (2006.01) |

(52) U.S. Cl.

CPC ..... *B61L 25/026* (2013.01); *B61L 3/121* (2013.01); *B61L 25/02* (2013.01); *B61L 25/023* (2013.01); *B61L 25/025* (2013.01); *B61L 25/04* (2013.01)

(58) Field of Classification Search

CPC ..... B61L 29/24; B61L 29/18; B61L 29/00; B61L 29/32; B61L 29/246; B61L 25/025; B61L 25/02; B61L 25/021; B61L 2205/04; B61L 1/188; B61L 27/088

See application file for complete search history.

(56) References Cited

U.S. PATENT DOCUMENTS

| | | | |
|---|---|---|---|
| 4,768,740 | A | 9/1988 | Corrie |
| 4,804,961 | A | 2/1989 | Hane |
| 4,851,851 | A | 7/1989 | Hane |
| 5,227,803 | A | 7/1993 | O'Connor et al. |
| 5,332,180 | A | 7/1994 | Peterson |

(Continued)

FOREIGN PATENT DOCUMENTS

| | | |
|---|---|---|
| CA | 952221 | 7/1974 |
| DE | 102007043460 B4 | 3/2009 |

(Continued)

OTHER PUBLICATIONS

International Search Report for corresponding International PCT Application No. PCT/IB2014/060455 dated Jul. 15, 2014.

(Continued)

*Primary Examiner* — Jason C Smith
(74) *Attorney, Agent, or Firm* — Hauptman Ham, LLP

(57) ABSTRACT

A method of determining a position of a vehicle on a guideway includes detecting a position of the vehicle relative to a first reflective positioning element along the guideway. The method also includes detecting a unique identification code of a transponder along the guideway, wherein the transponder is located a first known distance along the guideway from the first reflective positioning element. The method further includes determining the position of the vehicle, using a position determining system, based on a modulated reflection signal received from the transponder, a first non-modulated reflection signal received from the first reflective positioning element, and the first known distance.

20 Claims, 6 Drawing Sheets

(56) References Cited

U.S. PATENT DOCUMENTS

| | | | | |
|---|---|---|---|---|
| 5,351,052 | A | 9/1994 | D'Hont et al. | |
| 5,532,697 | A | 7/1996 | Hidaka et al. | |
| 5,602,919 | A | 2/1997 | Hurta | |
| 5,686,928 | A | 11/1997 | Pritchett et al. | |
| 5,719,567 | A | 2/1998 | Norris | |
| 6,072,421 | A * | 6/2000 | Fukae | G01S 13/876 342/126 |
| 6,179,252 | B1 * | 1/2001 | Roop | B61L 29/18 246/122 R |
| 6,219,596 | B1 | 4/2001 | Fukae et al. | |
| 7,145,475 | B2 | 12/2006 | Kavner | |
| 7,196,636 | B2 * | 3/2007 | Graham | B61L 29/28 246/122 R |
| 7,315,770 | B2 * | 1/2008 | Wade | B61L 29/00 246/1 R |
| 7,347,379 | B2 | 3/2008 | Ward et al. | |
| 7,388,483 | B2 * | 6/2008 | Welles | B61L 5/02 200/61.45 M |
| 7,626,488 | B2 | 12/2009 | Armstrong | |
| 7,769,544 | B2 * | 8/2010 | Blesener | B61L 29/28 246/124 |
| 7,772,996 | B2 * | 8/2010 | Burns | G08G 1/164 340/988 |
| 8,297,558 | B2 * | 10/2012 | O'Dell | B61L 29/226 246/126 |
| 8,630,757 | B2 * | 1/2014 | Daum | B61L 3/006 701/19 |
| 8,838,301 | B2 * | 9/2014 | Makkinejad | 246/3 |
| 2002/0017979 | A1 | 2/2002 | Krause et al. | |
| 2010/0141454 | A1 | 6/2010 | Bantin | |
| 2010/0271188 | A1 | 10/2010 | Nysen | |
| 2011/0084176 | A1 * | 4/2011 | Reichelt | B61L 23/041 246/473.1 |
| 2011/0095139 | A1 * | 4/2011 | O'Dell | B61L 29/28 246/293 |
| 2012/0323474 | A1 * | 12/2012 | Breed | B60W 30/04 701/117 |
| 2013/0062474 | A1 * | 3/2013 | Baldwin | B61L 29/282 246/122 R |
| 2013/0270395 | A1 * | 10/2013 | Steffen, II | B61L 29/226 246/125 |
| 2014/0012438 | A1 * | 1/2014 | Shoppa | B61L 1/188 701/19 |
| 2014/0263857 | A1 * | 9/2014 | Huntimer | B61L 25/025 246/122 R |
| 2014/0326835 | A1 * | 11/2014 | Schwellnus | B61L 25/02 246/122 R |

FOREIGN PATENT DOCUMENTS

| | | |
|---|---|---|
| EP | 0487708 B1 | 6/1992 |
| EP | 0 961 134 A1 | 12/1999 |
| JP | H0686215 | 11/1994 |
| JP | 9002269 | 1/1997 |

OTHER PUBLICATIONS

European Office Action for corresponding European Application dated May 23, 2016.

* cited by examiner

METHOD OF DETERMINING A POSITION OF A VEHICLE ON A GUIDEWAY

PRIORITY CLAIM

The present application is a divisional of U.S. application Ser. No. 13/886,674, filed May 3, 2013, which is incorporated herein by reference in its entirety.

BACKGROUND

Determining a position of each vehicle in a guideway network helps to maintain precise control and coordinated movement of vehicles in the guideway network. In some instances, vehicle positioning information is generated using on-guideway devices positioned on a guideway, such as axle counters or track circuits, which generate a position signal in response to the presence of the vehicle on the guideway at the location of the on-guideway device.

In some instances, vehicle positioning information is generated by an isolated transponder which receives a signal from the vehicle and transmits a modulated signal back to the vehicle. The modulated signal provides a unique identification of the transponder used to determine the position of the vehicle.

BRIEF DESCRIPTION OF THE DRAWINGS

One or more embodiments are illustrated by way of example, and not by limitation, in the figures of the accompanying drawings, wherein elements having the same reference numeral designations represent like elements throughout. It is emphasized that, in accordance with standard practice in the industry various features may not be drawn to scale and are used for illustration purposes only. In fact, the dimensions of the various features in the drawings may be arbitrarily increased or decreased for clarity of discussion. The figures of the drawings are incorporated herein and include the following wherein.

DETAILED DESCRIPTION

Figure 1:
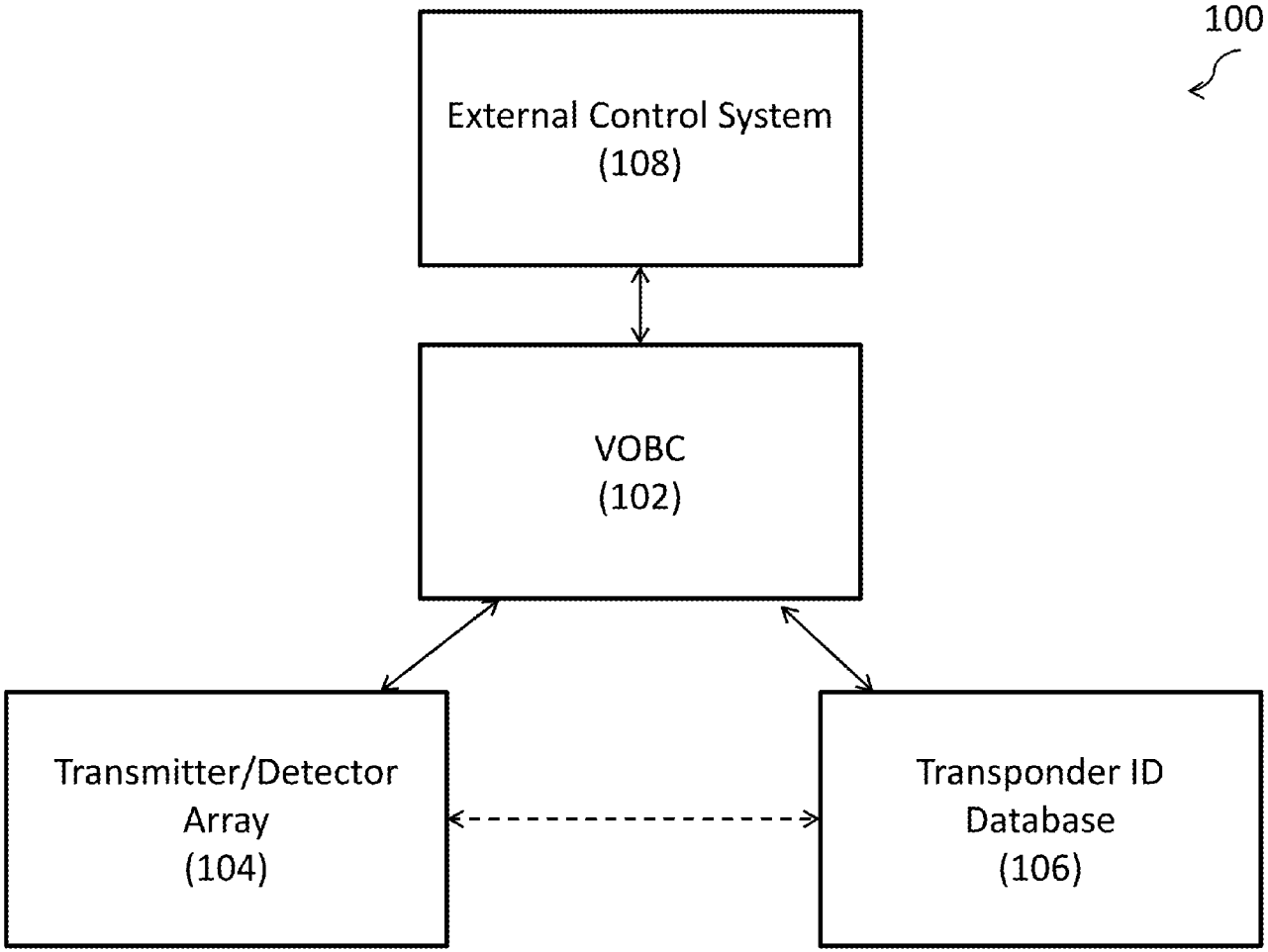
FIG. 1 is a block diagram of a vehicle position determining system in accordance with one or more embodiments.

The following disclosure provides many different embodiments, or examples, for implementing different features of the invention. Specific examples of components and arrangements are described below to simplify the present disclosure. These are examples and are not intended to be limiting.

As automated control of vehicles traveling along guideways increases, precision of position determination of the vehicles becomes more important. In some instances, positioning systems relying solely on a transponder having a unique identification code are capable of determining a position of the vehicle with an accuracy of approximately 2 meters (m). In some automatically controlled systems, a higher degree of precision helps to ensure accurate stopping locations for the vehicle. For example, a system seeking to align exit doors of a vehicle with certain positions on a platform, such as entry gates, doorways or other demarcations, would be aided by a higher degree of position accuracy. In some embodiments, a position determining system detects a location of a reflective positioning element and a transponder and is capable of determining the position of the vehicle within an accuracy of approximately 3 centimeters (cm). The increased precision of the position determination facilitates alignment of exit doors of the vehicle with positions on the platform, for example. The increased precision also increases efficiency of control for multiple vehicles along the guideway by reducing a potential error in the position for each of the vehicles on the guideway.

In some embodiments, the position determining system also provides an advantage of determining a heading of the vehicle using a single transponder. In other position determining systems, the heading of the vehicle is determined by comparing the unique identification code of consecutive transponders. In some instances, a distance between consecutive transponders is significant which delays determination of the heading of the vehicle until the vehicle can traverse the distance between the consecutive transponders. If transponders are positioned too close together, a risk of the unique identification code of two consecutive transponders interfering with each other increases. In addition, the cost of installing and maintaining the transponders increases as a number of transponders on the guideway increases. In some embodiments, the position determining system determines the heading of the vehicle by detecting a single transponder and two reflective positioning elements positioned along the guideway. The use of a single transponder decreases installation and maintenance costs. The use of the two reflective positioning elements also helps reduce a delay time in determining the heading of the vehicle because the reflective positioning elements can be located close to the transponder without a risk of interference with the unique identification code of the transponder. The use of the two reflective positioning elements also helps to increase accuracy of the position determining system in comparison with a single reflective positioning element arrangement.

FIG. 1 is a block diagram of a position determining system 100 in accordance with one or more embodiments. Position determining system 100 includes a vital on-board controller (VOBC) 102 configured to determine a position of the vehicle along the guideway. Position determining system 100 further includes a transmitter/detector array 104 configured to transmit a signal to interrogate positioning elements along the guideway and receive signals from the interrogated positioning elements. Position determining system 100 further includes a transponder ID database 106 configured to store the unique identification codes of transponders and a corresponding position along the guideway. Position determining system 100 further includes an external control system 108 configured to communicate with VOBC 102.

In some embodiments, VOBC 102 is implemented by running a background process on every vital machine having safety integrity level 4 (SIL 4) in the system which listens to communication traffic and collects key data as identified by a configuration profile of the VOBC. SIL 4 is based on International Electrotechnical Commission's (IEC) standard IEC 61508. SIL level 4 means the probability of failure per hour ranges from $10^{-8}$ to $10^{-9}$.

In some embodiments, VOBC 102 is configured to communicate with transmitter/detector array 104 through a wired or wireless connection. In some embodiments, transmitter/detector array 104 is incorporated into VOBC 102. In some embodiments, VOBC 102 is configured to communicate with transponder ID database 106 through a wired or wireless connection. In some embodiments, transponder identification (ID) database 106 is incorporated into VOBC 102. VOBC 102 is configured to communicate with external control system 108 via a wireless connection. In at least some embodiments, a wireless connection comprises a radio frequency signal, an inductive loop signal, an optical signal, a microwave signal, or another suitable signal. VOBC 102 is configured to transmit position information to external control system 108. In some embodiments, VOBC 102 is configured to transmit heading information to external control system 108. VOBC 102 is configured to receive information, such as movement authority instructions, updates for transponder ID database 106, switch positions along the guideway, position information for other vehicles along the guideway, or other suitable information, from external control system 108.

Transmitter/detector array 104 is configured to emit an interrogation signal for interrogating positioning elements positioned along the guideway. In some embodiments, the interrogation signal is a single wavelength unique to the vehicle. In some embodiments, the interrogation signal includes a tunable wavelength. Transmitter/detector array 104 is configured to receive signals from the positioning elements. The signals from the positioning elements include a reflected signal of the interrogation signal or a modulated reflection signal based on the interrogation signal, in some embodiments. In some embodiments, the signals from the positioning elements are analyzed by circuitry in transmitter/detector array 104 and the result of the analysis is transmitted to VOBC 102. In some embodiments, the signals from the positioning elements are received by transmitter/detector array 104 and are sent directly to VOBC 102 and are analyzed by circuitry in the VOBC. Additional details of some embodiments of transmitter/detector array 104 are provided below in reference to FIG. 2.

Transponder ID database 106 is a non-transitory computer readable medium configured to store the unique identification codes of transponders disposed along the guideway cross-referenced with a location of the transponder along the guideway. In some embodiments, VOBC 102 is configured to update transponder ID database 106 based on information received from external control system 108. In some embodiments, transponder ID database 106 includes the unique identification codes for less than all of the transponders along the guideway. In some embodiments, transponder ID database 106 includes the unique identification codes for all of the transponders along the guideway. In some embodiments where the signals from the positioning elements are analyzed in the transmitter/detector array 104, the transmitter/detector array is configured to communication with transponder ID database 106.

External control system 108 is configured to communicate with VOBC 102. In some embodiments, external control system 108 is a de-centralized control system configured to control movement of vehicles along less than an entirety of a guideway network. In some embodiments, external control system 108 is a centralized control system configured to control movement of vehicles along the entirety of the guideway network. In some embodiments, external control system 108 is configured to provide movement instructions to VOBC 102 which are implemented by a driver or by an automatic speed and braking control system (not shown). In some embodiments, the movement instructions are based on position information received from VOBC 102. In some embodiments, external control system 108 is configured to receive position information from VOBC 102 and transmit movement instructions to other vehicles in the guideway network based on the position information from the VOBC.

Figure 2:
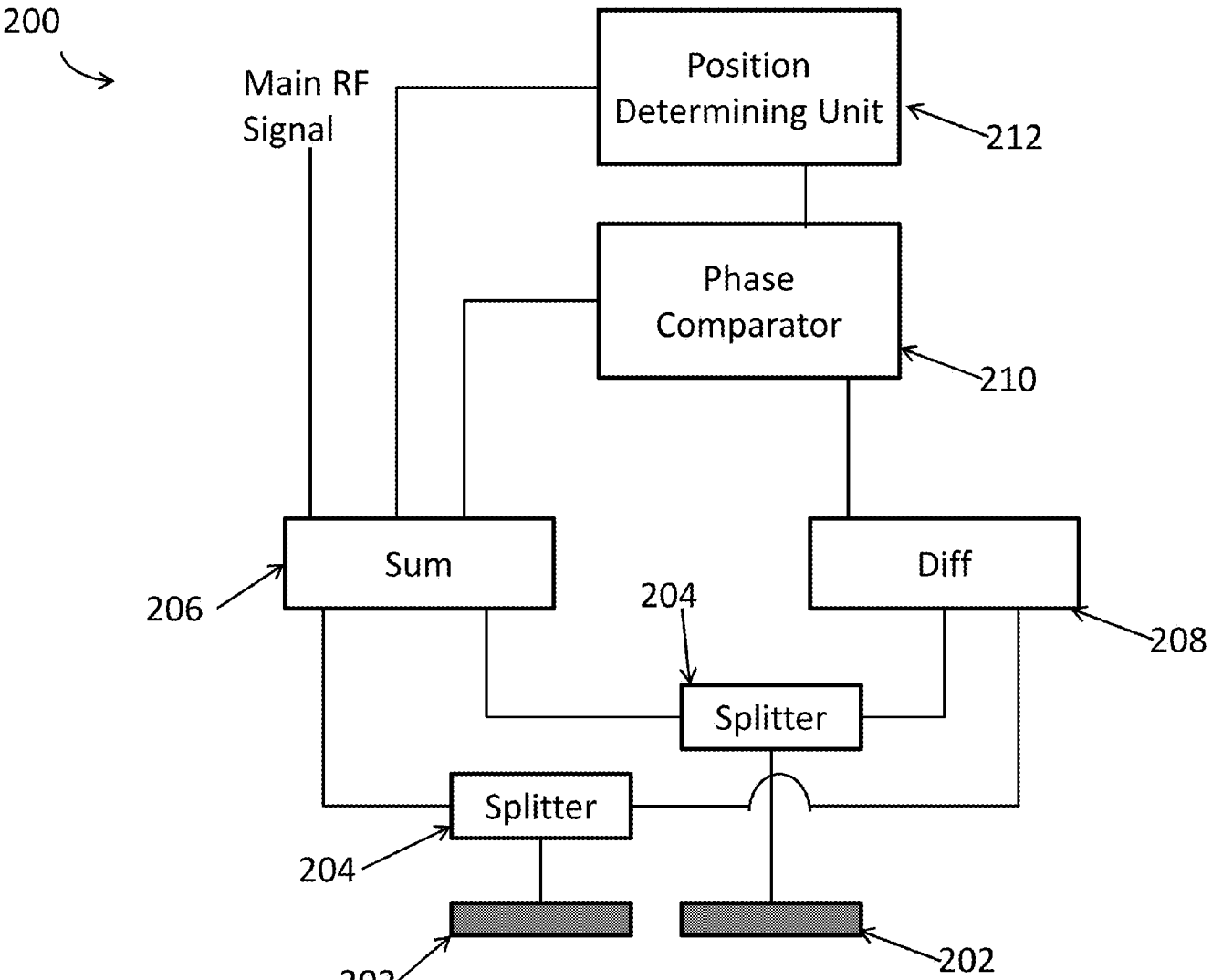
FIG. 2 is a block diagram of a transmitter/detector array on-board a vehicle in accordance with one or more embodiments.

FIG. 2 is a block diagram of a transmitter/detector array 200 in accordance with one or more embodiments. Transmitter/detector array 200 is configured to analyze signals received from positioning elements along the guideway. Transmitter/detector 200 includes at least two antennae 202 with one configured to emit interrogation signals and two or more configured to receive reflection signals. Antennae 202 are spaced from each other in a direction of travel along the guideway. Each antenna 202 is connected to a corresponding splitter 204 configured to split a signal received by the respective antenna. Each splitter 204 is connected to a summing circuit 206 configured to add the signals from the splitters 204 together. Each splitter 204 is also connected to a difference circuit 208 configured to determine a difference between the signals from the splitters 204. Summing circuit 206 and difference circuit 208 are both connected to a phase comparator 210 configured to compare the sum of the signals from the splitters 204 with a difference between the signals from the splitters. Transmitter/detector array 200 further includes a position detection unit 212 configured to determine if a highest magnitude sum from summing circuit 206 coincides with a determined phase difference of zero in order to identify a precise location of the positioning element. In some embodiments where the positioning element is a half-wavelength reflector, phase comparator 210 is configured to determine the half-wavelength reflector is located an equal distance from each antennae 202 if a phase of an output of summing circuit 206 matches a phase of an output of difference circuit 208.

Transmitter/detector 200 is also configured to receive a main radio frequency (RF) signal for interrogating the positioning elements at summing circuit 206. The main RF signal is received at summing circuit 206. In some embodiments, the main RF signal is received at a different location in transmitter/detector array 200. In some embodiments, the main RF signal is received from VOBC 102 (FIG. 1). In some embodiments, the main RF signal is received from a separate signal generator. In some embodiments, the main RF signal is generated by a signal generator within transmitter/detector array 200. In some embodiments, a wavelength of the main RF signal is unique to the vehicle. In some embodiments, the wavelength of the main RF signal is tunable. In some embodiments, the wavelength of the main RF signal is in a radio frequency wavelength range. In some embodiments, the wavelength of the main RF signal is in an infrared frequency wavelength range.

In operation, summing circuit 206 receives the main RF signal and transmits the main RF signal to splitters 204, which in turn supply the main RF signal to at least one antenna of antennae 202. Antennae 202 convert the main RF signal into the interrogation signal and emit the interrogation signal. In some embodiments, antennae 202 emit the interrogation signal continuously. In some embodiments, antennae 202 emit the interrogation signal in a pulsed manner. Antennae 202 also receive reflection signals from positioning elements along the guideway. In some embodiments, the reflection signals are modulated reflections of the interrogation signal. In some embodiments, the reflection signals include the unique identification code of a transponder. In some embodiments, the reflection signals are non-modulated reflections of the interrogation signals.

Antennae 202 convert the reflection signals to detection signals and transmit the detection signals to the respective splitters 204. Splitters 204 split the detection signals and transfer the split detection signals to both summing circuit 206 and difference circuit 204. Summing circuit 206 determines a sum of the split detection signals and transmits the sum to phase comparator 210 and position determining unit 212. Difference circuit 208 determines a difference between the split detection signals and transmits the difference to phase comparator 210.

Phase comparator 210 determines a phase difference between the sum and the difference. Phase comparator 210 outputs a determined phase difference. Phase comparator 210 determines a reflective positioning element, e.g., a half-wavelength reflector, is positioned an equal distance from each antennae 202 if the determined phase difference is zero. Determining the position of the vehicle based on the phase difference between the received signals of antennae 202 increases precision of the position determination. Position detection unit 212 receives the sum from summing circuit 206. Position detection unit 212 also receives the determined phase difference and determines whether the sum from summing circuit 206 is at the highest magnitude. The vehicle is directly over the reflective positioning element if the phase difference is equal to zero and the sum is at the highest magnitude. In some embodiments, transmitter/detector array 200 determines the position of the vehicle relative to the reflective positioning element within an error of less than 3 cm.

Antennae 202 also detect the modulated reflection signal from a transponder. In some embodiments, a separate antenna detects the modulated reflection signal from the transponder. In operation, transmitter/detector array 200 receives the modulated reflection signal and transmits the modulated reflection signal to VOBC 102 (FIG. 1). In some embodiments, transmitter/detector array 200 identifies the unique identification code of the transponder and transmits the unique identification code to VOBC 102. In some embodiments, transmitter/detector array 200 transmits the modulated reflection signal to VOBC 102, and the VOBC identifies the unique identification code of the transponder.

Figure 3:
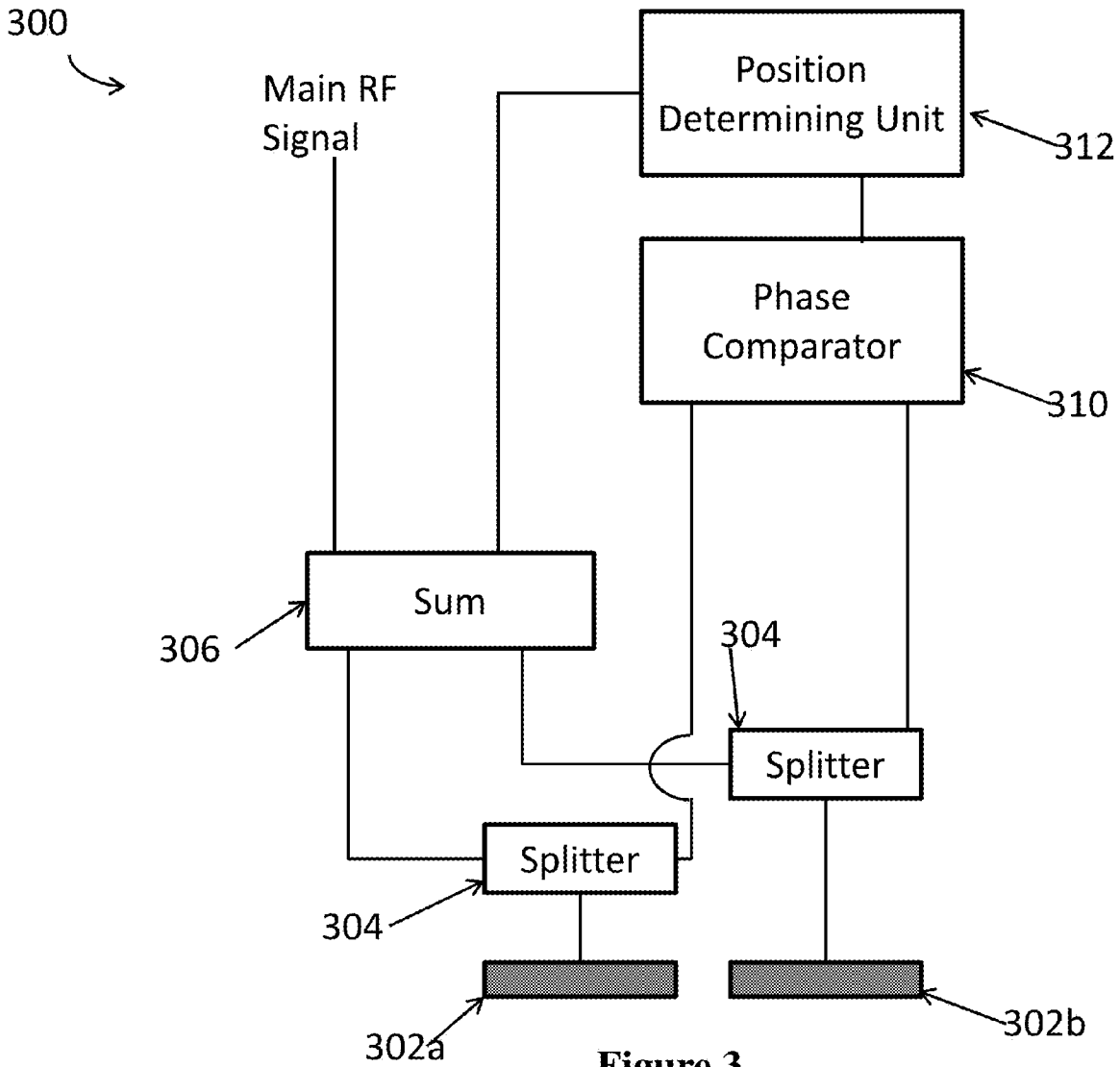
FIG. 3 is a block diagram of a transmitter/detector array on-board a vehicle in accordance with one or more embodiments.

FIG. 3 is a block diagram of a transmitter/detector array 300 on-board a vehicle in accordance with one or more embodiments. Transmitter/detector array 300 is similar to transmitter/detector array 200, transmitter/detector array 300 does not include difference circuit 208. Similar elements in transmitter/detector array 300 are labeled with a same reference number as in transmitter/detector array 200 increased by 100. Phase comparator 310 is configured to determine a phase difference of the reflection signals received directly from splitters 304.

In operation, the interrogation signal is transmitted on one antenna 302*a*. In some embodiments, antenna 302*a* emits the interrogation signal continuously. In some embodiments, antenna 302*a* emits the interrogation signal in a pulsed manner. Both antennae 302*a* and 302*b* receive reflection signals from positioning elements along the guideway. Antennae 302 convert the reflection signals to detection signals and transmit the detection signals to the respective splitters 304. Splitters 204 split the detection signals and transfer the split detection signals to both summing circuit 304 and phase comparator 310. Summing circuit 306 determines a sum of the split detection signals and transmits the sum to position determining unit 312.

Phase comparator 310 determines a phase difference between signals received directly from splitters 304. Phase comparator 310 outputs a determined phase difference. Position detection unit 312 receives the sum from summing circuit 306. Position detection unit 312 also receives the determined phase difference and determines whether the sum from summing circuit 306 is at the highest magnitude. The vehicle is directly over the reflective positioning element if the phase difference is equal to zero and the sum is at the highest magnitude. In some embodiments, transmitter/detector array 300 determines the position of the vehicle relative to the reflective positioning element within an error of less than 3 cm.

Antennae 302 also detect the modulated reflection signal from a transponder. In some embodiments, a separate antenna detects the modulated reflection signal from the transponder. In operation, transmitter/detector array 300 receives the modulated reflection signal and transmits the modulated reflection signal to VOBC 102 (FIG. 1). In some embodiments, transmitter/detector array 300 identifies the unique identification code of the transponder and transmits the unique identification code to VOBC 102. In some embodiments, transmitter/detector array 300 transmits the modulated reflection signal to VOBC 102, and the VOBC identifies the unique identification code of the transponder.

Figure 4:
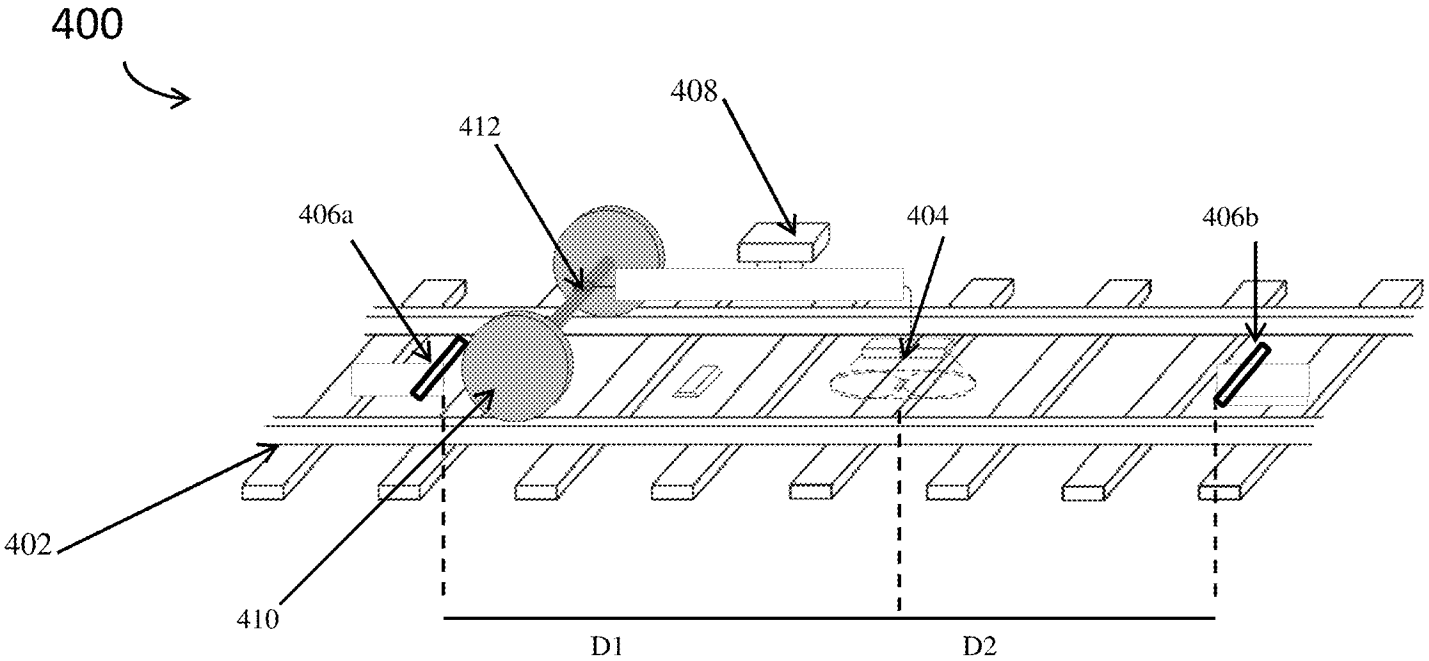
FIG. 4 is a schematic diagram of a vehicle position determining arrangement disposed along a guideway in accordance with one or more embodiments.

FIG. 4 is a schematic diagram of a vehicle position determining arrangement 400 disposed along a guideway 402 in accordance with one or more embodiments. Vehicle position determining arrangement 400 includes a transponder 404 having a unique identification code. Vehicle position determining arrangement 400 further includes a first reflective positioning element 406*a* and a second reflective positioning element 406*b* positioned along guideway 402 and spaced on opposite sides of transponder 404 along the guideway. First reflective positioning element 406*a* is spaced a first distance D1 from transponder 404. Second reflective positioning element 406*b* is spaced a second distance D2 from transponder 404. First distance D1 is different from second distance D2. Vehicle position determining arrangement 400 also includes an external control system 408 configured to communicate with transponder 404 and a vehicle 410. Only a portion of vehicle 410 is present in FIG. 4 for clarity and ease of explanation. A position determining system 412 is disposed on-board vehicle 410. Position determining system 412 is located on an axle of vehicle 410. In some embodiments, position determining system 412 is located on an undercarriage of vehicle 410, inside the vehicle, on a side panel of the vehicle or in another suitable position on the vehicle.

Guideway 402 is a dual rail guideway. In some embodiments, guideway 402 is a single rail guideway. In some embodiments, guideway 402 is free of rails.

Transponder 404 is configured to receive the interrogation signal from position determining system 412 and transmit the modulated reflection signal which includes the unique identification code for the transponder. Transponder 404 is located between rails of guideway 402. In some embodiments, transponder 404 is positioned on a wayside of guideway 402.

First reflective positioning element 406*a* and second reflective positioning element 406*b* are configured to reflect the interrogation signal without modulating or modifying the reflection signal. First reflective positioning element 406*a* and second reflective positioning element 406*b* are located between the rails of guideway 402. In some embodiments, first reflective positioning element 406*a* and second reflective positioning element 406*b* are located outside the rails of guideway 402, on a supporting device located on the wayside of the guideway, on a wall of a tunnel, or at other suitable locations. In some embodiments, first reflective positioning element 406*a* and second reflective positioning element 406*b* are half-wavelength reflectors. Half-wavelength reflectors have a dimension, in the direction of travel, approximately equal to half of the wavelength of the interrogation signal. In some embodiments, first reflective positioning element 406*a* and second reflective positioning element 406*b* comprise copper, aluminum, or another suitable reflective material.

First reflective positioning element 406*a* and second reflective positioning element 406*b* are spaced from transponder 404 in a single dimension. In some embodiments, reflective positioning element 406*a* and second reflective positioning element 406*b* are spaced from transponder 404 in two or three dimensions, so long as a distance in the direction of travel along guideway 402 between the transponder and the first and second reflective positioning elements is known. First distance D1 is greater than second distance D2. In some embodiments, second distance D2 is greater than first distance D1. In some embodiments, second reflective positioning element 406*b* is omitted.

External control 408 is positioned on the wayside of guideway 402. In some embodiments, external control 408 is a de-centralized control. In some embodiments, external control 408 is a centralized control. External control 408 is configured to communicate with position determining system 412 on-board vehicle 410 and transponder 404. External control 408 is configured to determine whether transponder 404 is functioning properly. In some embodiments, position determining system 412 determines whether transponder 404 is functioning properly based on a direction of travel and a database of transponder locations. External control 408 is also configured to receive position information from position determining system 412 and to provide movement instructions to the position determining system or an automatic speed and braking system on-board vehicle 410. In some embodiments, external control 408 is configured to transmit update information to position determining system 412 for updating a transponder ID database, e.g., transponder ID database 106 (FIG. 1).

Vehicle 410 is a rail mounted vehicle. In some embodiments, vehicle 410 is a train, a roller coaster, a monorail, a magnetic guided vehicle, or another suitable vehicle.

Positioning determining system 412 is configured to determine a position of vehicle 410 along guideway 402 based on transponder 404, at least one of first reflective positioning element 406*a* or second reflective positioning element 406*b*, and a corresponding first distance D1 or second distance D2. In some embodiments, position determining system 412 is position determining system 100 (FIG. 1).

In operation, as vehicle 410 travels along guideway 402, position determining system 412 emits the interrogation signal. In this example, vehicle 410 is traveling so as to pass, in order, first reflective positioning element 406*a*, transponder 404 and second reflective positioning element 406*b*. Position determining system 412 interrogates first reflective positioning element 406*a* and receives the reflection signal. Position determining system 412 determines the precise position of vehicle 410 relative to the first reflective positioning element, as described above with respect to transmitter/detector array 200 (FIG. 2) or transmitter/detector array 300 (FIG. 3). As vehicle 410 continues along guideway 402, position determining system 412 interrogates transponder 304 and receives the modulated reflection signal including the unique identification code of the transponder. Position determining system 412 identifies the absolute location of transponder 404 using the transponder ID database, e.g., transponder ID database 106. Position determining system 412 uses the determined position relative to first reflective positioning element 406*a*, the known location of transponder 404 having the detected unique identification code, and the known first distance D1 to calculate the position of vehicle 410. In some embodiments, the accuracy of the position determination is less than a 3 cm error.

Using a single reflective positioning element, position determining system 412 is able to determine the position of vehicle 410 along guideway 402. Using two reflective positioning elements, position determining system 412 is able to determine both the position of vehicle 410 and the heading of the vehicle. Continuing with the example above, as vehicle 410 passes second reflective positioning element 406*b*, position determining system 412 determines when the vehicle is passing the second reflective positioning element. Using a known distance travelled by vehicle 410 after passing transponder 404, position determining system 412 calculates a distance traveled between the transponder and second reflective positioning element 406*b*. Position determining system 412 compares the calculated time with first distance D1 and second distance D2 to determine the heading of vehicle. That is, position determining system 412 determines in which order vehicle 410 passes the first reflective positioning element 306*a* and second reflective positioning element 406*b* based on the calculated distance traveled and the known first distance D1 and the known second distance D2.

Figure 5:
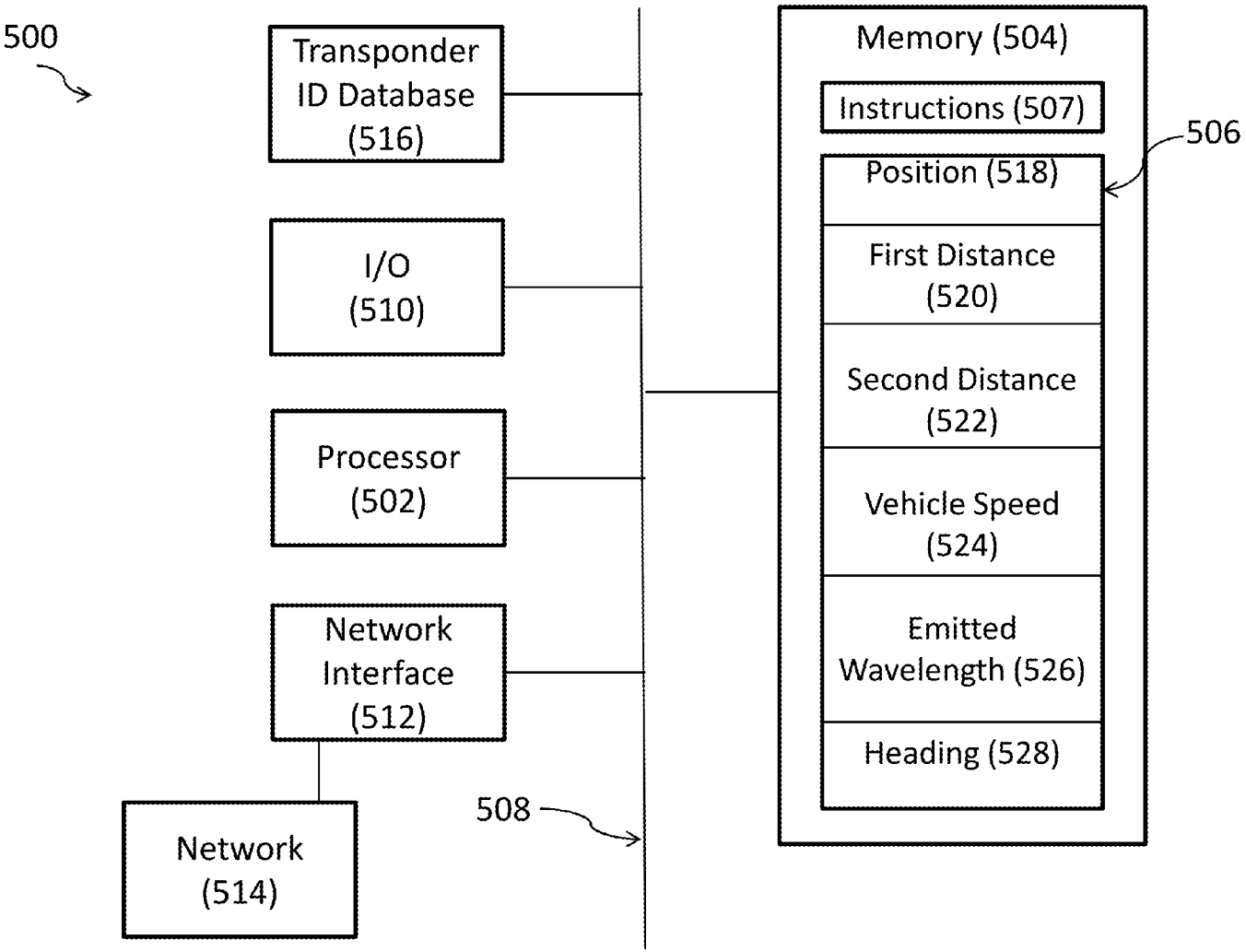
FIG. 5 is a block diagram of a general purpose computing device for implementing the vehicle position determining system shown in FIG. 1 in accordance with one or more embodiments.

FIG. 5 is a block diagram of a general purpose computing device for implementing a position determining system 500 in accordance with one or more embodiments. In some embodiments, position determining system 500 is similar to position determining system 412 (FIG. 4). Position determining system 500 includes a hardware processor 502 and a non-transitory, computer readable storage medium 504 encoded with, i.e., storing, the computer program code 506, i.e., a set of executable instructions. Computer readable storage medium 504 is also encoded with instructions 507 for interfacing with elements of position determining system 500. The processor 502 is electrically coupled to the computer readable storage medium 504 via a bus 508. The processor 502 is also electrically coupled to an I/O interface 510 by bus 508. A network interface 512 is also electrically connected to the processor 502 via bus 508. Network interface 512 is connected to a network 514, so that processor 502 and computer readable storage medium 504 are capable of connecting and communicating to external elements, e.g., external control 108 (FIG. 1) or external control 408 (FIG. 4), via network 514. In some embodiments, network interface 512 is replaced with a different communication path such as optical communication, microwave communication, inductive loop communication, or other suitable communication paths. A transponder ID database 516 is also electrically connected to the processor 502 via bus 508. Transponder ID database 516 stores positions and unique identification codes of transponders along the guideway. The processor 502 is configured to execute the computer program code 506 encoded in the computer readable storage medium 504 in order to cause position determining system 500 to be usable for performing a portion or all of the operations as described with respect to position determining system 100 (FIG. 1), transmitter/detector array 200 (FIG. 2), transmitter/detector array 300 (FIG. 3), position determining system 412 (FIG. 4) or a method 600 (FIG. 6).

In some embodiments, the processor 502 is a central processing unit (CPU), a multi-processor, a distributed processing system, an application specific integrated circuit (ASIC), and/or a suitable processing unit. In some embodiments, processor 502 is configured to generate position information signals for transmitting to external circuitry via network interface 512. In some embodiments, processor 502 is configured to update transponder ID database 516 based on information received via network interface 512.

In some embodiments, the computer readable storage medium 504 is an electronic, magnetic, optical, electromagnetic, infrared, and/or a semiconductor system (or apparatus or device). For example, the computer readable storage medium 304 includes a semiconductor or solid-state memory, a magnetic tape, a removable computer diskette, a random access memory (RAM), a read-only memory (ROM), a rigid magnetic disk, and/or an optical disk. In some embodiments using optical disks, the computer readable storage medium 504 includes a compact disk-read only memory (CD-ROM), a compact disk-read/write (CD-R/W), and/or a digital video disc (DVD). In some embodiments, the computer readable storage medium 404 is part of an embedded microcontroller or a system on chip (SoC).

Figure 6:
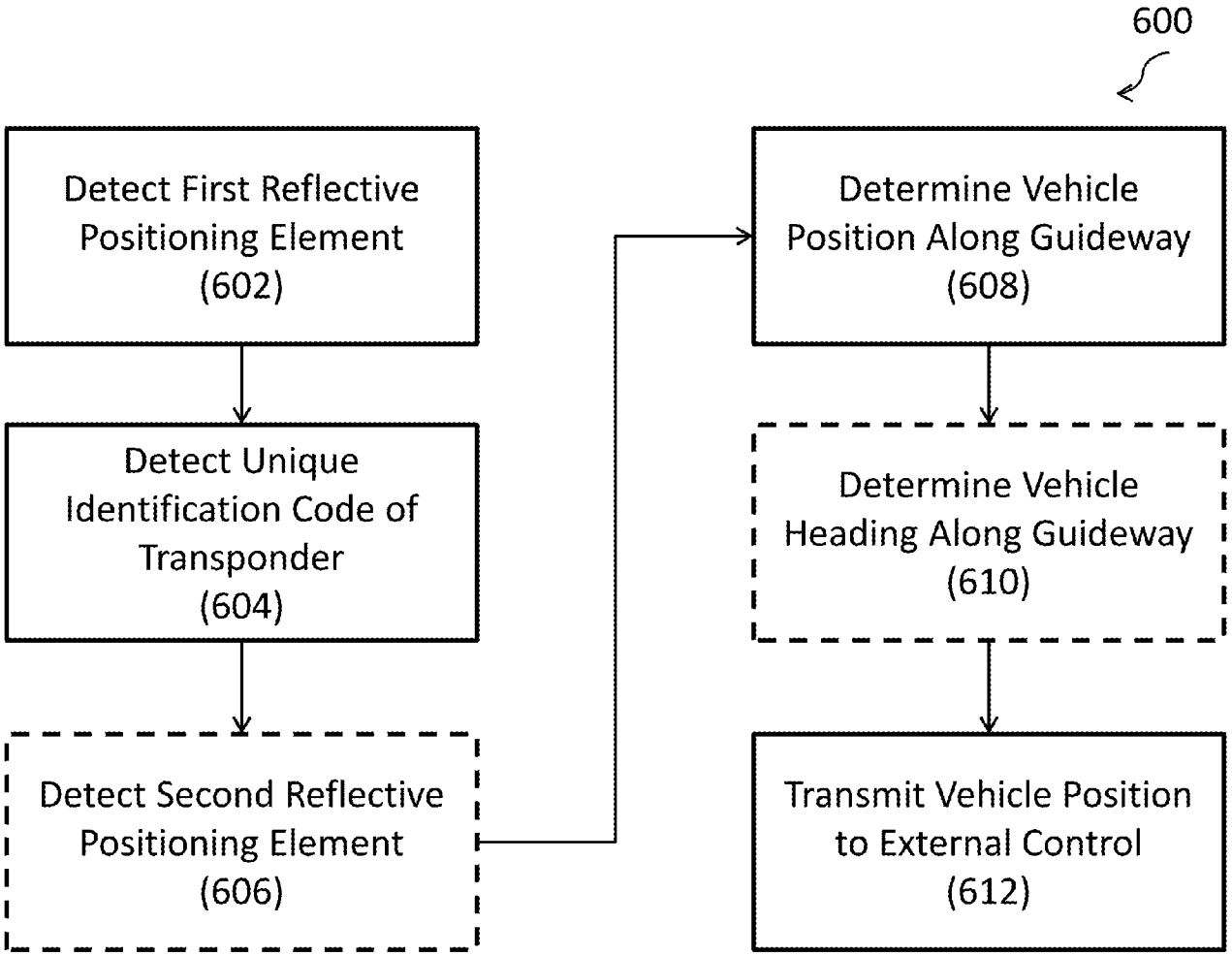
FIG. 6 is a flow chart of a method of determining a vehicle position in accordance with one or more embodiments.

In some embodiments, the storage medium 504 stores the computer program code 506 configured to cause position determining system 500 to perform the operations as described with respect to position determining system 100 (FIG. 1), transmitter/detector array 200 (FIG. 2), transmitter/detector array 300 (FIG. 3), position determining system 412 (FIG. 4) or method 600 (FIG. 6). In some embodiments, the storage medium 504 also stores information needed for performing the operations as described with respect to position determining system 500, such as a position parameter 518, a first distance parameter 520, a second distance parameter 522, a vehicle speed parameter 524, an emitted wavelength parameter 526, a heading parameter 528 and/or a set of executable instructions to perform the operation as described with respect to position determining system 500.

In some embodiments, the storage medium 504 stores instructions 507 for interfacing with external components. The instructions 507 enable processor 502 to generate operating instructions readable by the external components to effectively implement the operations as described with respect to position determining system 500.

Position determining system 500 includes I/O interface 510. I/O interface 510 is coupled to external circuitry. In some embodiments, I/O interface 510 is configured to receive instructions from a port in an embedded controller.

Position determining system 500 also includes network interface 512 coupled to the processor 502. Network interface 512 allows position determining system 500 to communicate with network 514, to which one or more other computer systems are connected. Network interface 512 includes wireless network interfaces such as BLUETOOTH, WIFI, WIMAX, GPRS, or WCDMA; or wired network interface such as ETHERNET, USB, IEEE-1394, or asynchronous or synchronous communications links, such as RS485, CAN or HDLC. In some embodiments, the operations as described with respect to position determining system 500 are implemented in two or more position determining systems, and information such as position, first distance, second distance, vehicle speed, emitted wavelength and heading are exchanged between different position determining system 500 via network 514.

Position determining system 500 also includes transponder ID database 516 coupled to the processor 502. Transponder ID database 516 stores unique identification codes of transponders cross referenced with the position of the transponder along the guideway. Transponder ID database 516 allows position determining system 500 to determine the position of the vehicle based on the stored transponder position.

Position determining system 500 is configured to receive information related to the position from a transmitter/detector array, e.g., transmitter/detector array 200 (FIG. 2), or transmitter/detector array 300. The information is transferred to processor 502 via bus 508 to determine a position of the vehicle along the guideway. The position is then stored in computer readable medium 504 as position parameter 518. In some embodiments, processor 502 determines a heading of the vehicle along the guideway. The position is then stored in computer readable medium 504 as heading parameter 528. Position determining system 500 is configured to receive information related to the vehicle speed through I/O interface 510 or network interface 512. The information is then stored in computer readable medium 504 as vehicle speed parameter 524. Position determining system 500 is configured to receive information related to the first distance through I/O interface 510 or network interface 512. The information is then stored in computer readable medium 504 as first distance parameter 520. Position determining system 500 is configured to receive information related to the second distance through I/O interface 510 or network interface 512. The information is then stored in computer readable medium 504 as second distance parameter 522. Position determining system 500 is configured to receive information related to the emitted wavelength through I/O interface 510 or network interface 512. The information is then stored in computer readable medium 504 as emitted wavelength parameter 526.

During operation, processor 502 executes a set of instructions to determine a position of the vehicle along the guideway based on a comparison of the parameters stored in computer readable medium 504 and the stored unique identification codes of transponder ID database 516.

FIG. 6 is a flow chart of a method 600 of determining a vehicle position in accordance with one or more embodiments. In operation 602, a position determining system, e.g., position determining system 100, position determining system 412 or position determining system 500, detects a position of a first reflective positioning element, e.g., first reflective positioning element 406*b* (FIG. 4). The positioning determining system detects the first reflective positioning element using a transmitter/detector array, e.g., transmitter/detector array 200 (FIG. 2), or transmitter/detector array 300 (FIG. 3). The position determining system detects the position of the vehicle when the first reflective positioning element is located an equal distance from each antenna of the transmitter/detector array.

In operation 604, the position determining system detects a unique identification code of a transponder, e.g., transponder 404 (FIG. 4). Position determining system detects the unique identification code of the transponder based on a modulated reflection signal.

In optional operation 606, the position determining system detects a second reflective positioning element, e.g., second reflective positioning element 406*b*. The positioning determining system detects the second reflective positioning element using a transmitter/detector array, e.g., transmitter/detector array 200. The position determining system detects the position of the vehicle when the second reflective positioning element is located an equal distance from each antenna of the transmitter/detector array. Operation 606 is omitted if determining a heading of the vehicle is not necessary or desired.

In operation 608, the positioning determining system determines the position of the vehicle along the guideway. The position determining system determines the position of the vehicle by determining a position where the vehicle passed the first reflective positioning element, identifying the transponder closest to the first reflective positioning element and calculating the vehicle position based on a known distance along the guideway between the first reflective element and the known location of the transponder.

In optional operation 610, the position determining system determines a heading of the vehicle along the guideway. The position determining system determines the heading of the vehicle by calculating a distance between the transponder and the second reflective positioning element and comparing the calculated distance with known distances between the first reflective positioning element and the transponder and between the second reflective positioning element and the transponder. Operation 610 is omitted if determining a heading of the vehicle is not necessary or desired.

In operation 612, the position determining system transmits the vehicle position information to an external control, e.g., external control 108 (FIG. 1) or external control 408 (FIG. 4). The position determining system transmits the vehicle position information using a network interface, e.g., network interface 512. In some embodiments, the position determining system transmits the vehicle position information via an inductive loop communication system, a radio communication system, an optical communication system or other suitable communication means.

One of ordinary skill in the art would recognize the order of the above operations is adjustable. For example, in some embodiments, the unique identification code of the transponder is detected prior to detecting the first reflective positioning element. One of ordinary skill in the art would recognize additional operations are able to be added, in some embodiments.

An aspect of this description relates to a method of determining a position of a vehicle on a guideway. The method comprises detecting a position of the vehicle relative to a first reflective positioning element along the guideway. The method also comprises detecting a unique identification code of a transponder along the guideway, wherein the transponder is located a first known distance along the guideway from the first reflective positioning element. The method further comprises determining the position of the vehicle, using a position determining system, based on a modulated reflection signal received from the transponder, a first non-modulated reflection signal received from the first reflective positioning element, and the first known distance.

Another aspect of this description relates to a method of determining a position of a vehicle on a guideway. The method comprises emitting an interrogation signal from a position determining system on-board the vehicle. The method also comprises receiving a modulated reflection signal having a unique identification code by the position determining system, the modulated reflection signal being received from a transponder configured to receive the interrogation signal and emit the modulated reflection signal in response to the interrogation signal. The method further comprises receiving a first non-modulated reflection signal by the position determining system from a first reflective positioning element configured to receive the interrogation signal and to reflect the interrogation signal to form the first non-modulated reflection signal. The method additionally comprises processing the modulated reflection signal and the first non-modulated reflection signal to determine the position of the vehicle on the guideway relative to the first reflective positioning element.

A further aspect of this description relates to a method of determining a position of a vehicle on a guideway. The method comprises detecting a position of the vehicle relative to a first reflective positioning element along the guideway. The method also comprises detecting a closest transponder of a plurality of transponders along the guideway, wherein the closest transponder is located a first known distance along the guideway from the first reflective positioning element. The method further comprises determining the position of the vehicle, using a position determining system, based on a modulated reflection signal received from the closest transponder, a first non-modulated reflection signal received from the first reflective positioning element, and the first known distance.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A method of determining a position of a vehicle on a guideway, the method comprising:

receiving a first non-modulated reflection signal by a first antenna on-board the vehicle, the first non-modulated reflection signal being associated with a first reflective positioning element along the guideway;

receiving the first non-modulated reflection signal by a second antenna on-board the vehicle;

determining a difference between the first non-modulated signal received by the first antenna and the first non-modulated signal received by the second antenna;

detecting a position of the vehicle relative to the first reflective positioning element along the guideway based on the difference between the first non-modulated signal received by the first antenna and the first non-modulated signal received by the second antenna;

detecting a unique identification code of a transponder along the guideway, wherein the transponder is located a first known distance along the guideway from the first reflective positioning element; and determining the position of the vehicle on the guideway, using a position determining system, based on a modulated reflection signal received from the transponder, the position of the vehicle relative to the first reflective positioning element, and the first known distance.

2. The method of claim 1, further comprising:

transmitting the determined position of the vehicle on the guideway to an external control system.

3. The method of claim 1, further comprising:

detecting a position of the vehicle relative to a second reflective positioning element along the guideway, the transponder located a second known distance along the guideway from the second reflective positioning element; and determining a heading of the vehicle based on the modulated reflection signal, a second non-modulated reflection signal received from the second reflective positioning element, the first known distance and the second known distance.

4. The method of claim 1, wherein detecting the position of the vehicle relative to the first reflective positioning element comprises detecting the position of the vehicle relative to a half-wavelength reflector.

5. The method of claim 1, further comprising:

receiving update information from an external control system; and updating a transponder identification database of the position determining system using the update information.

6. A method of determining a position of a vehicle on a guideway, the method comprising:

emitting an interrogation signal from a position determining system on-board the vehicle;

receiving a modulated reflection signal having a unique identification code by the position determining system, the modulated reflection signal being received from a transponder configured to receive the interrogation signal and emit the modulated reflection signal in response to the interrogation signal;

receiving a first non-modulated reflection signal by the position determining system from a first reflective positioning element configured to receive the interrogation signal and to reflect the interrogation signal to form the first non-modulated reflection signal, the first non-modulated reflection signal being received by a first antenna on-board the vehicle, and by a second antenna on-board the vehicle;

detecting a position of the vehicle relative to the first reflective positioning element along the guideway based on a phase difference between the first non-modulated signal received by the first antenna and the first non-modulated signal received by the second antenna; and processing the modulated reflection signal and the position of the vehicle relative to the first reflective to determine the position of the vehicle on the guideway.

7. The method of claim 6, wherein the first reflective positioning element is located a first known distance along the guideway from the transponder, and the method further comprises:

processing the position relative to the first reflective positioning element and the first known distance along the guideway from the transponder to determine the position of the vehicle on the guideway.

8. The method of claim 7, further comprising:

communicating the determined position of the vehicle on the guideway to an external control system.

9. The method of claim 6, further comprising:

detecting a position of the vehicle relative to a second reflective positioning element along the guideway; and processing the modulated reflection signal, the position of the vehicle on the guideway relative to the first reflective positioning element, and a second non-modulated reflection signal received from the second reflective positioning element to determine a heading of the vehicle along the guideway.

10. The method of claim 9, wherein the first reflective positioning element is located a first known distance along the guideway from the transponder, the second reflective positioning element is located a second known distance along the guideway from the transponder, and the method further comprises:

processing the first known distance and the second known distance to determine the heading of the vehicle along the guideway.

11. The method of claim 10, wherein the first known distance is different from the second known distance.

12. The method of claim 6, further comprising:

receiving update information from an external control system; and updating a transponder identification database of the position determining system using the update information.

13. A method of determining a position of a vehicle on a guideway, the method comprising:

detecting a position of the vehicle relative to a first reflective positioning element along the guideway;

detecting a closest transponder of a plurality of transponders along the guideway, wherein the closest transponder is located a first known distance along the guideway from the first reflective positioning element; and determining the position of the vehicle, using a position determining system, based on a modulated reflection signal received from the closest transponder, a first non-modulated reflection signal received from the first reflective positioning element, and the first known distance, wherein detecting the position of the vehicle relative to the first reflective positioning element comprises:

receiving the first non-modulated reflection signal by a first antenna on-board the vehicle and by a second antenna on-board the vehicle;

splitting each of the first non-modulated reflection signal received by the first antenna and by the second antenna;

generating a sum signal by adding the split first non-modulated signal received by the first antenna and the split first non-modulated signal received by the second antenna; and comparing the sum signal with the split first non-modulated signal received by the first antenna and with the split first non-modulated signal received by the second antenna to determine a phase difference between the sum signal and the split signals.

14. The method of claim 13, further comprising:

transmitting the position of the vehicle on the guideway to an external control system.

15. The method of claim 13, further comprising:

detecting a position of the vehicle relative to a second reflective positioning element along the guideway, the closest transponder being located a second known distance along the guideway from the second reflective positioning element; and determining a heading of the vehicle based on the modulated reflection signal, a second non-modulated reflection signal received from the second reflective positioning element, the first known distance, and the second known distance.

16. The method of claim 15, wherein the heading is further based on a determination of an order by which the first non-modulated reflection signal and the second non-modulated reflection signal are received.

17. The method of claim 13, wherein detecting the position of the vehicle relative to the first reflective positioning element comprises detecting the position of the vehicle relative to a half-wavelength reflector.

18. The method of claim 13, further comprising:

receiving update information from an external control system; and updating a transponder identification database of the position determining system using the update information.

19. The method of claim 13, further comprising:

determining the vehicle is directly over the first reflective positioning element if the phase difference is equal to zero and the sum signal is at a maximum amplitude.

20. The method of claim 13, further comprising:

determining a difference between the split first non-modulated signal received by the first antenna and the split first-modulated signal received by the second antenna, wherein the phase difference is based on the sum signal and the difference between the split first non-modulated signal received by the first antenna and the split first-modulated signal received by the second antenna.

* * * * *